US006382529B1

(12) United States Patent
Wu

(10) Patent No.: US 6,382,529 B1
(45) Date of Patent: May 7, 2002

(54) WATER SPRAYER

(76) Inventor: Sheng-Li Wu, 58, Ma Yuan West St., Taichung (TW)

( * ) Notice: Subject to any disclaimer, the term of this patent is extended or adjusted under 35 U.S.C. 154(b) by 0 days.

(21) Appl. No.: 09/968,050

(22) Filed: Sep. 28, 2001

(51) Int. Cl.[7] ..... B05B 7/02; B05B 9/01
(52) U.S. Cl. ..... 239/525; 239/526; 239/569
(58) Field of Search ..... 239/525, 526, 239/530, 569

(56) References Cited

U.S. PATENT DOCUMENTS 5,806,770 A * 9/1998 Wang ..... 239/526 X
5,967,421 A * 10/1999 Wang ..... 239/526
5,967,422 A * 10/1999 Wang ..... 239/526
6,007,003 A * 12/1999 Wang ..... 239/525
6,173,911 B1 * 1/2001 Hui-Chen ..... 239/526
6,260,774 B1 * 7/2001 Erickson ..... 239/526

* cited by examiner

*Primary Examiner*—Robin O. Evans

(57) ABSTRACT

A water sprayer has a hollow handle, a sprayer head connected to the hollow handle, a button device, a push trigger, a shaft, an O-ring, and a spring. The hollow handle has a longitudinal channel, a transverse channel communicating with the longitudinal channel, a chamber, and a hollow post. A rubber washer, a piston, and a sieve are inserted in the lower stepped hole of the hollow handle. The button device and the push trigger are inserted in the chamber of the hollow handle. The opening of the push trigger receives the button device. The shaft has a disk head and an annular groove. The O-ring encloses the annular groove of the shaft. The spring surrounds the shaft. The shaft is inserted through the hollow post.

1 Claim, 8 Drawing Sheets

WATER SPRAYER

BACKGROUND OF THE INVENTION

The present invention relates to a water sprayer. More particularly, the present invention relates to a water sprayer which has a button device engaging with a push trigger.

Referring to FIGS. 1 to 3, a conventional water sprayer has a hollow handle 11, a sprayer head 10' connected to the hollow handle 11', a button device 60', a push trigger 70', a shaft 80', an O-ring 90', a first spring S1', and a second spring S2'. The hollow handle 11' has a longitudinal channel 12', a transverse channel 13' communicating with the longitudinal channel 12', two circular holes 17', a chamber 14', a column 15', and a hollow post 16'. A rubber washer 50', a piston 30', a sieve 40', and an annular gasket 20' are inserted in the longitudinal channel 12' of the hollow handle 11'. The piston 30' has a neck 31' and a head rod 32' inserted in the rubber washer 50'. The button device 60' has a click block 61', a hollow pillar 62', and a lower hook 63'. The push trigger 70' has a protruded block 73', an opening 71', and two lateral protrusions 72'. The shaft 80' has a disk head 81' and an annular groove 82'. The O-ring 90' encloses the annular groove 82' of the shaft 80'. The second spring S2' surrounds the shaft 80' and the hollow post 16'. The shaft 80' is inserted through the hollow post 16'. The column 15' is inserted in the hollow pillar 62'. The first spring S1' surrounds the hollow pillar 62'. The push trigger 70' is inserted in the chamber 14' of the hollow handle 11'. The opening 71' of the push trigger 70' receives the button device 60'. The protruded block 73' blocks the disk head 81' of the shaft 80'. The lateral protrusions 72' are inserted in the circular holes 17' of the hollow handle 11'. The piston 30' is pressed downward by the shaft 80'. The lower hook 63' hooks the push trigger 70' (as shown in FIG. 3). However, the lower hook 63' is easily broken. Furthermore, it is cumbersome to assemble the first spring S1' and the second spring S2'.

SUMMARY OF THE INVENTION

An object of the present invention is to provide a water sprayer which has a button device engaging with a push trigger so that the button device and the push trigger are used for a long period of time.

Another object of the present invention is to provide a water sprayer which has a single spring for both a button device and a push trigger.

Accordingly, a water sprayer comprises a hollow handle, a sprayer head connected to the hollow handle, a button device, a push trigger, a shaft, an O-ring, and a spring. The hollow handle has a longitudinal channel, a transverse channel communicating with the longitudinal channel, two recess holes, a chamber, a hollow post, a lower stepped hole communicating with the longitudinal channel, and a bottom threaded hole communicating with the lower stepped hole. The hollow post communicates with the longitudinal channel of the hollow handle. A rubber washer, a piston, and a sieve are inserted in the lower stepped hole of the hollow handle. The annular gasket is inserted in the bottom threaded hole of the hollow handle. The piston has a neck and a head rod inserted in the rubber washer. The sieve has a plurality of meshes. The sieve is disposed on the annular gasket. The piston is disposed on the sieve. The button device has an upper click block, a pair of elastic blocks, a pair of upper pillars, a protruded block, and a rib. The push trigger has an upper opening, two upper protrusions, two upper bevels, and two upper flanges. The shaft has a disk head, an annular groove, and a tip end. The O-ring encloses the annular groove of the shaft. The shaft is inserted through the hollow post. The spring surrounds the shaft. The spring is disposed between the hollow post and the disk head of the shaft. The button device is inserted in the chamber of the hollow handle. The push trigger is inserted in the chamber of the hollow handle. The button device is disposed between the hollow handle and the push trigger. The upper opening of the push trigger receives the upper click block of the button device. The upper bevels of the push trigger block the upper pillars of the button device.

DETAILED DESCRIPTION OF THE INVENTION

Figure 1:
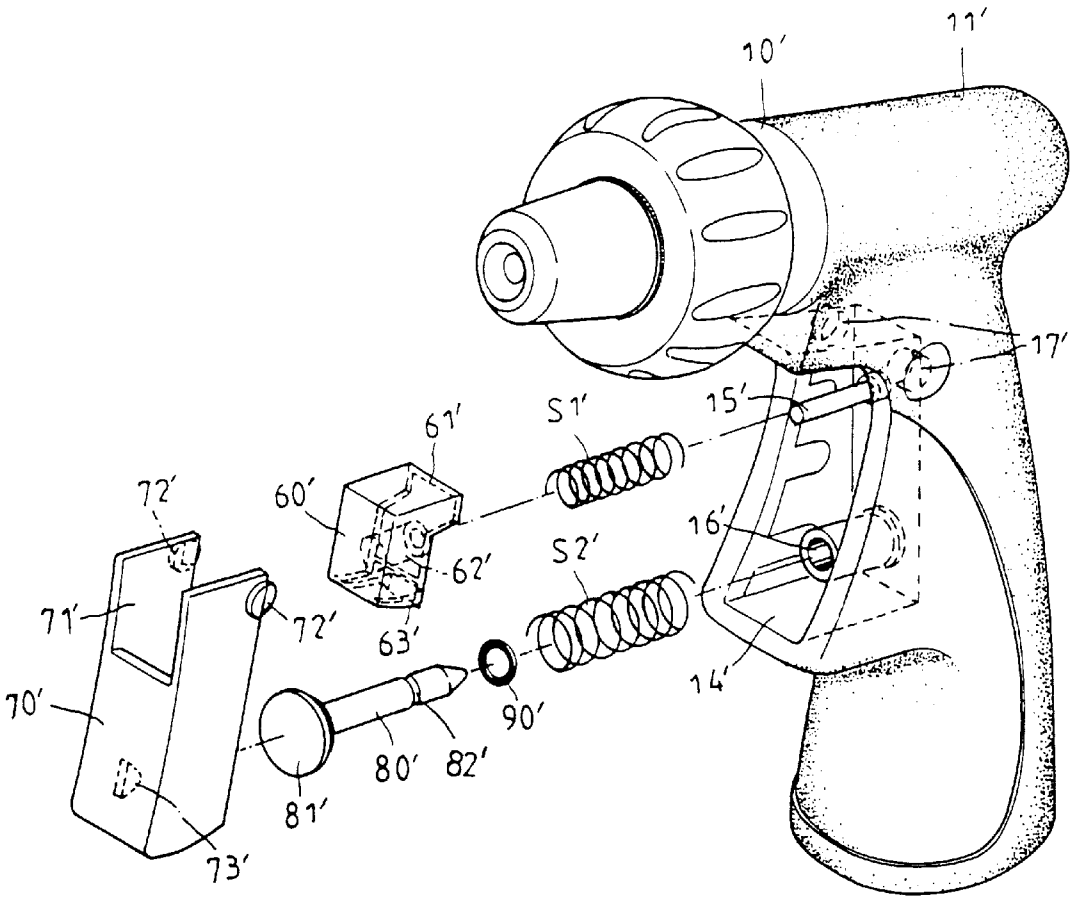
FIG. 1 PRIOR ART
FIG. 1 is a perspective exploded view of a conventional water sprayer of the prior art.
Figure 2:
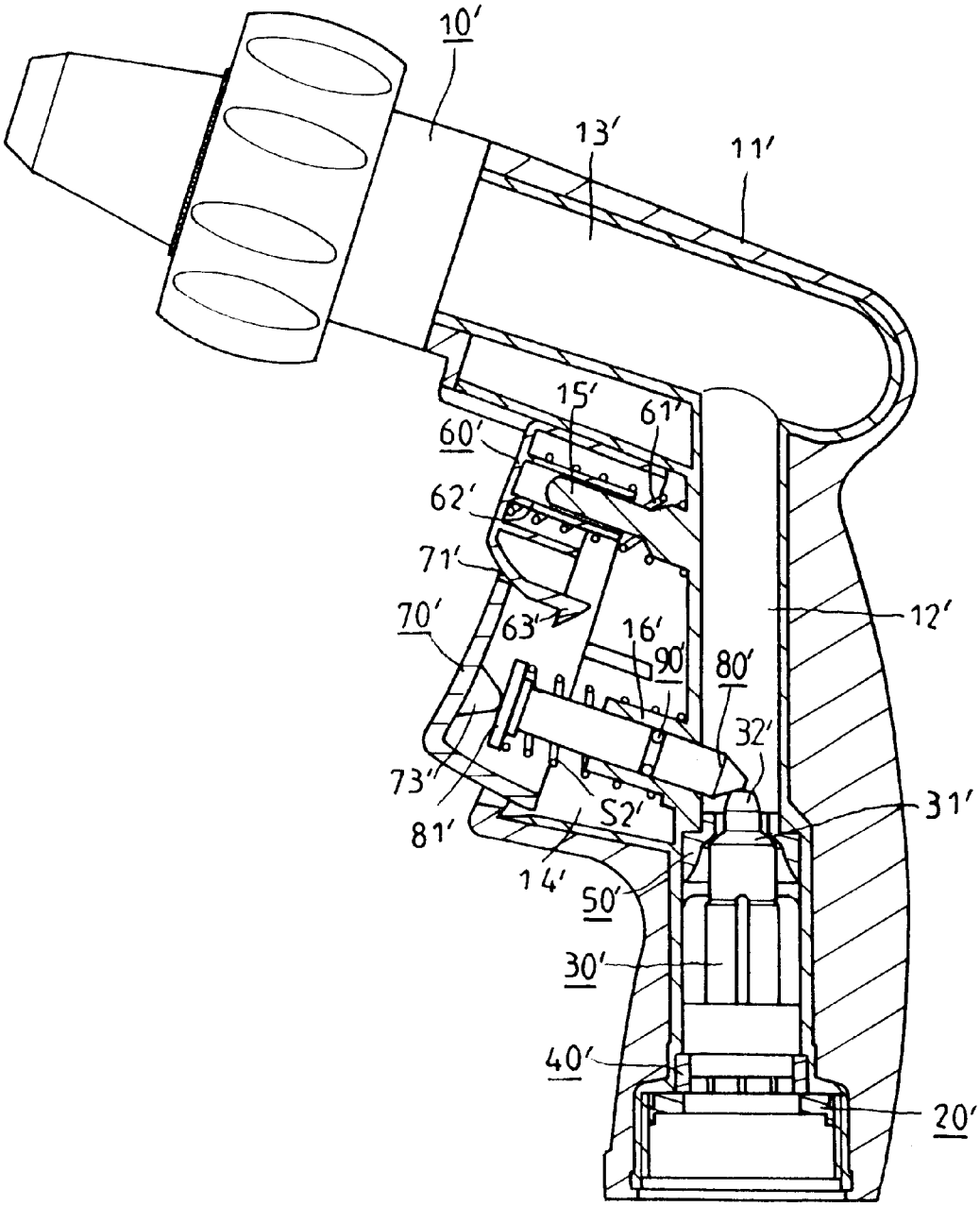
FIG. 2 PRIOR ART
FIG. 2 is a sectional assembly view of a conventional water sprayer of the prior art while a piston is not pressed downward by a shaft.
Figure 3:
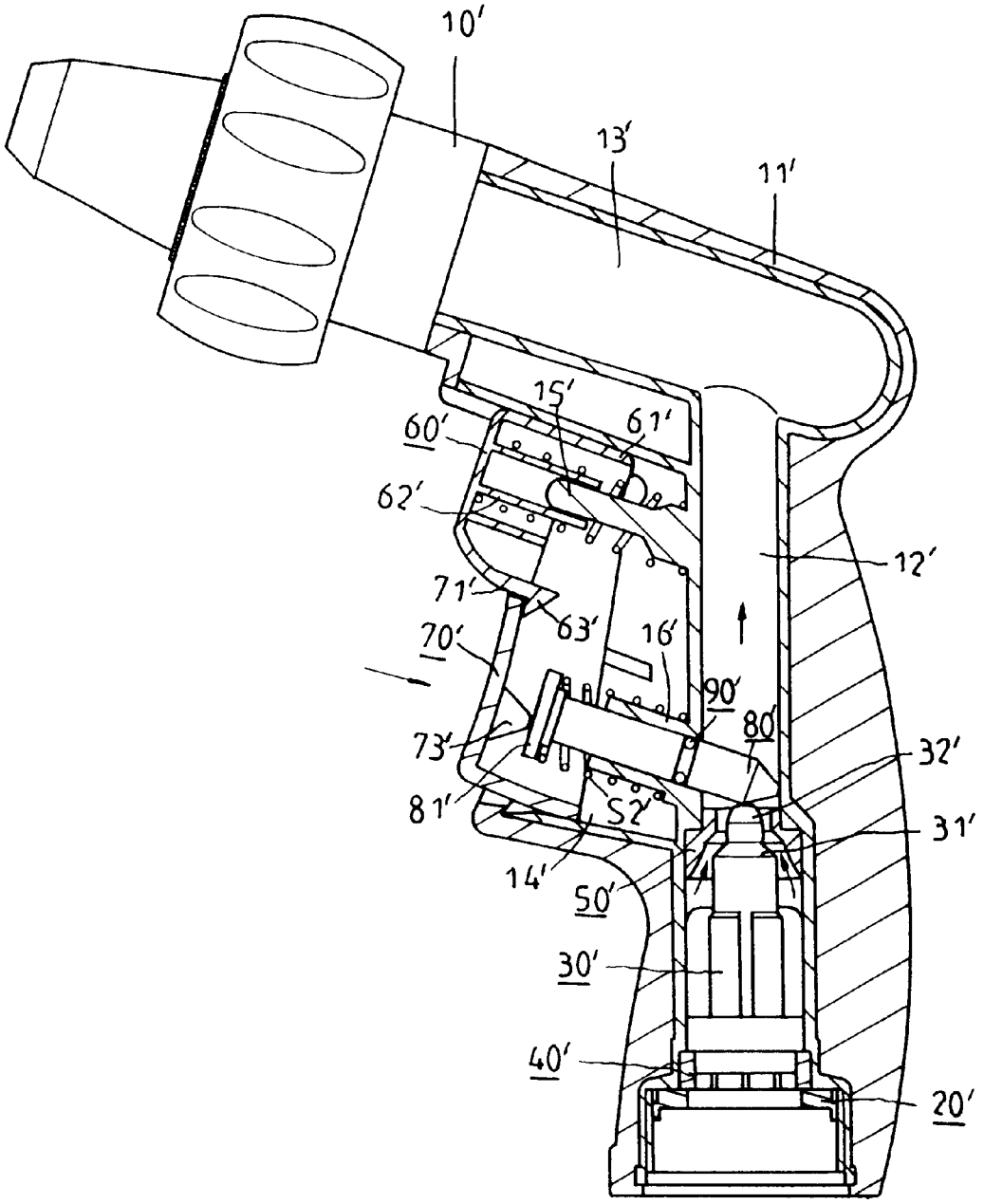
F I G. 3 PRIOR ART
FIG. 3 is a sectional assembly view of a conventional water sprayer of the prior art while a piston is pressed downward by a shaft.
Figure 4:
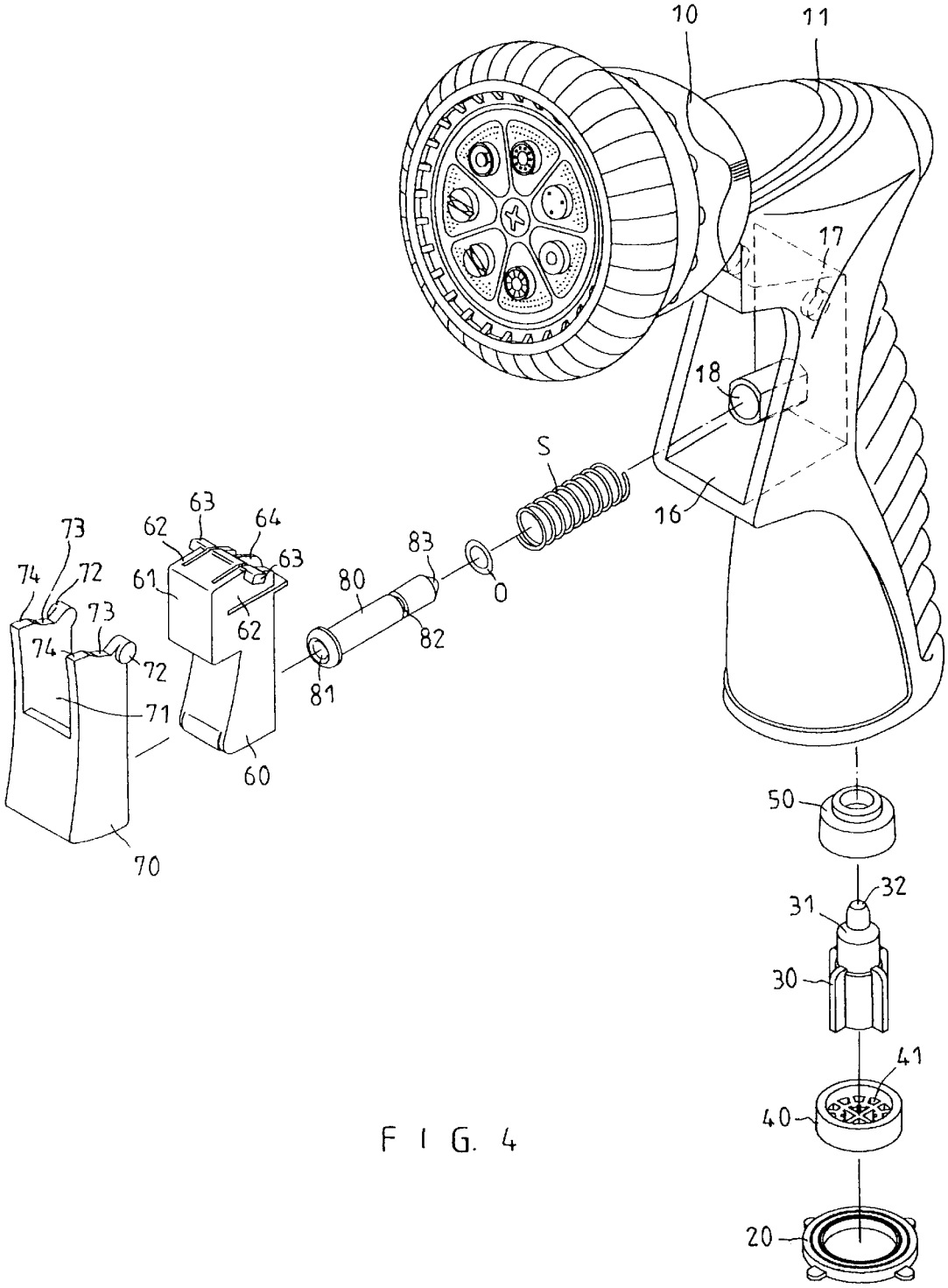
FIG. 4 is a perspective exploded view of a water sprayer of a preferred embodiment in accordance with the present invention.
Figure 4A:
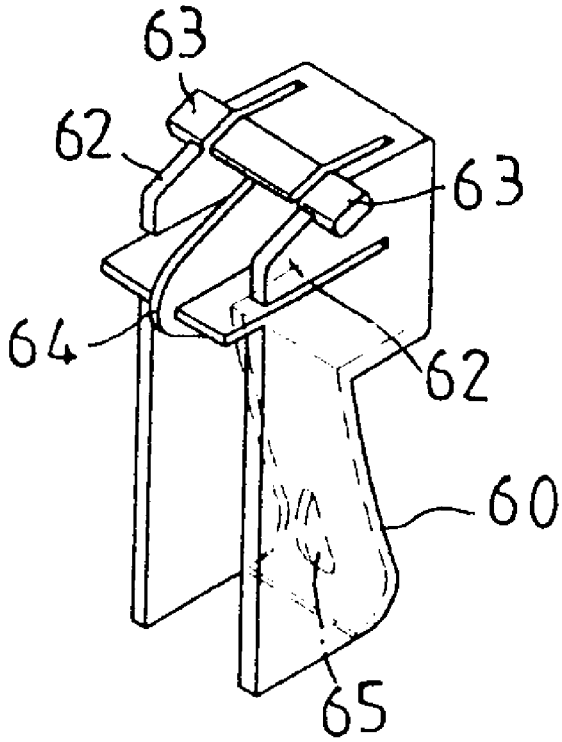
FIG. 4A is a perspective view of a button device of a preferred embodiment in accordance with the present invention.
Figure 5:
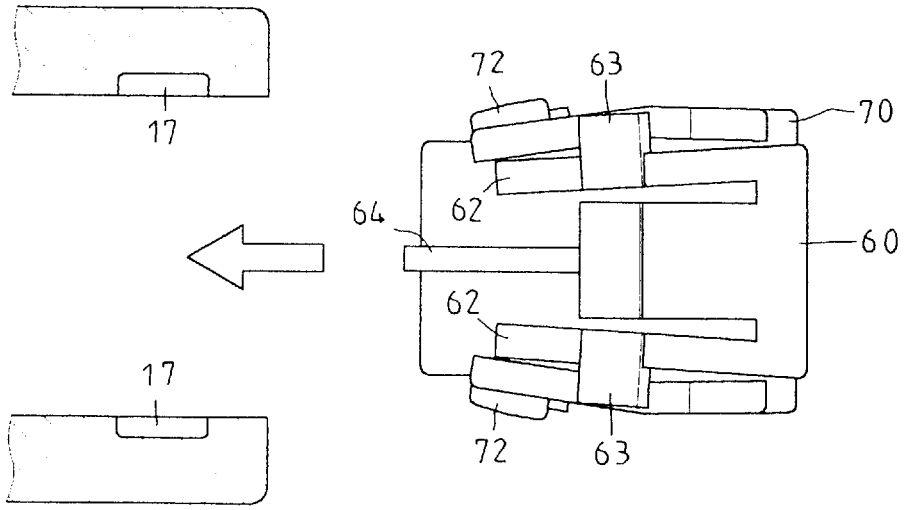
FIG. 5 is a sectional schematic view illustrating a button device engaging with a push trigger but disengaging from a chamber of a hollow handle.
Figure 6:
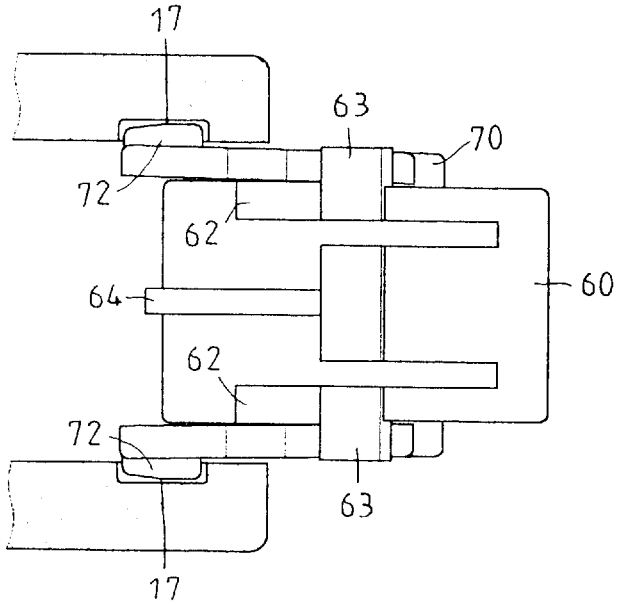
FIG. 6 is a sectional schematic view illustrating a button device engaging with a push trigger and a chamber of a hollow handle.
Figure 7:
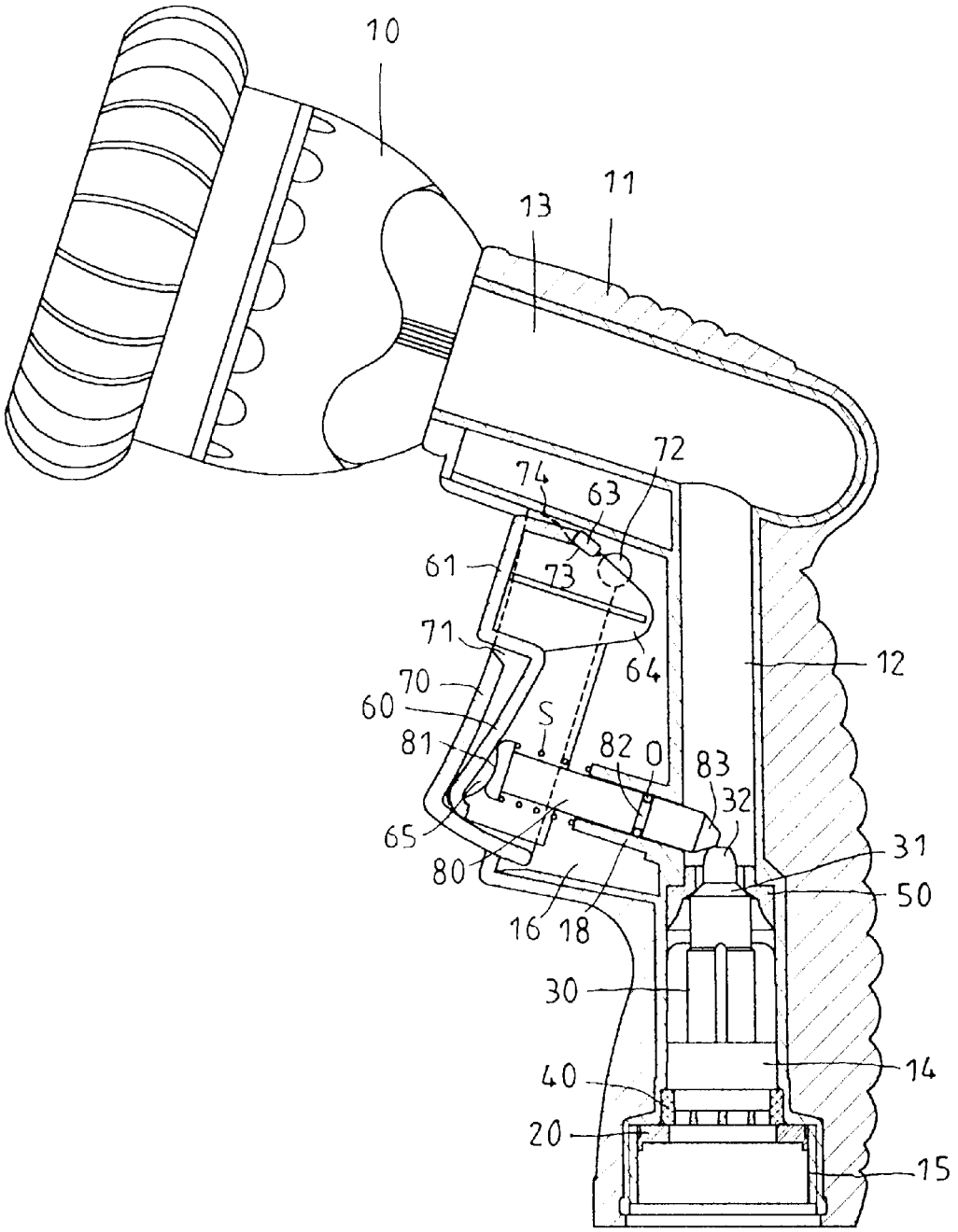
FIG. 7 is a sectional assembly view of a water sprayer of a preferred embodiment while a piston is not pressed downward by a shaft.
Figure 8:
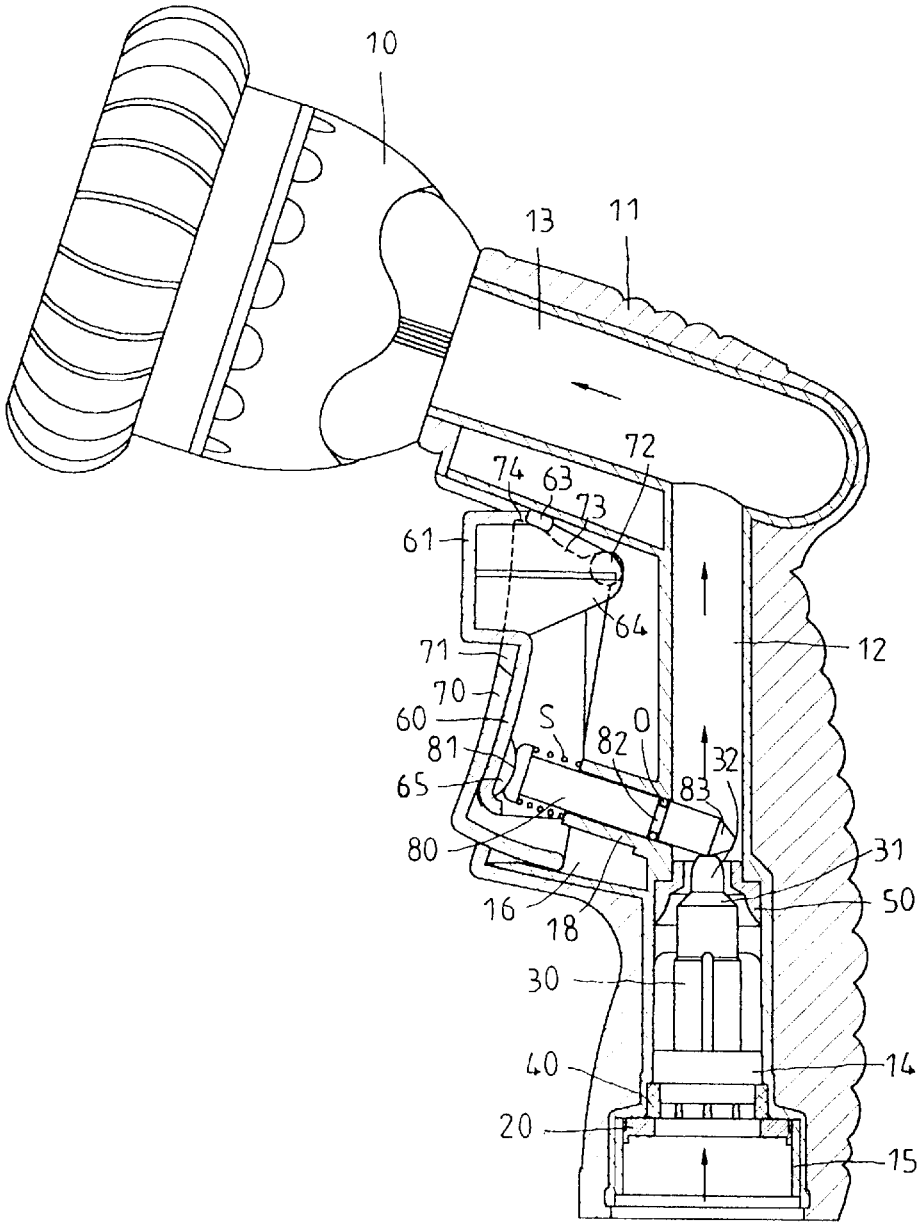
FIG. 8 is a sectional assembly view of a water sprayer of a preferred embodiment while a piston is pressed downward by a shaft.

Referring to FIGS. 4 to 8, a water sprayer comprises a hollow handle 11, a sprayer head 10 connected to the hollow handle 11, a button device 60, a push trigger 70, a shaft 80, an O-ring 90, and a spring S.

The hollow handle 11 has a longitudinal channel 12, a transverse channel 13 communicating with the longitudinal channel 12, two recess holes 17, a chamber 16, a hollow post 18, a lower stepped hole 14 communicating with the longitudinal channel 12, and a bottom threaded hole 15 communicating with the lower stepped hole 14.

The hollow post 18 communicates with the longitudinal channel 12 of the hollow handle 11.

A rubber washer 50, a piston 30, and a sieve 40 are inserted in the lower stepped hole 14 of the hollow handle 11.

The annular gasket 20 is inserted in the bottom threaded hole 15 of the hollow handle 11.

The piston 30 has a neck 31 and a head rod 32 inserted in the rubber washer 50.

The sieve 40 has a plurality of meshes 41.

The sieve 40 is disposed on the annular gasket 20.

The piston 30 is disposed on the sieve 40.

The button device 60 has an upper click block 61, a pair of elastic blocks 62, a pair of upper pillars 63, a protruded block 65, and a rib 64.

The push trigger 70 has an upper opening 71, two upper protrusions 72, two upper bevels 73, and two upper flanges 74.

The shaft 80 has a disk head 81, an annular groove 82, and a tip end 83.

The O-ring 90 encloses the annular groove 82 of the shaft 80.

The shaft 80 is inserted through the hollow post 18.

The spring S surrounds the shaft 80. The spring S is disposed between the hollow post 18 and the disk head 81 of the shaft 80.

The button device 60 is inserted in the chamber 16 of the hollow handle 11.

The push trigger 70 is inserted in the chamber 16 of the hollow handle 11.

The button device 60 is disposed between the hollow handle 11 and the push trigger 70.

The upper opening 71 of the push trigger 70 receives the upper click block 61 of the button device 60.

The upper bevels 73 of the push trigger 70 block the upper pillars 63 of the button device 60.

The protruded block 65 blocks the disk head 81 of the shaft 80.

Referring to FIG. 7 again, the spring S pushes the shaft 80, the button device 60, and the push trigger 70 outward. Then the neck 31 of the piston 30 blocks the longitudinal channel 12 of the hollow handle 11.

Referring to FIG. 8 again, the push trigger 70 is pushed inward. Then the tip end 83 of the shaft 80 pushes the head rod 32 of the piston 30 downward. Then the upper click block 61 of the button device 60 is pushed inward so that the push trigger 70 will be ejected outward.

The invention is not limited to the above embodiment but various modification thereof may be made. Further, various changes in form and detail may be made without departing from the scope of the invention.

I claim:

1. A water sprayer comprises:

a hollow handle, a sprayer head connected to the hollow handle, a button device, a push trigger, a shaft, an O-ring, and a spring, the hollow handle having a longitudinal channel, a transverse channel communicating with the longitudinal channel, two recess holes, a chamber, a hollow post, a lower stepped hole communicating with the longitudinal channel, and a bottom threaded hole communicating with the lower stepped hole, the hollow post communicating with the longitudinal channel of the hollow handle, a rubber washer, a piston, and a sieve inserted in the lower stepped hole of the hollow handle, an annular gasket inserted in the bottom threaded hole of the hollow handle, the piston having a neck and a head rod inserted in the rubber washer, the sieve having a plurality of meshes, the sieve disposed on the annular gasket, the piston disposed on the sieve, the button device having an upper click block, a pair of elastic blocks, a pair of upper pillars, a protruded block, and a rib, the push trigger having an upper opening, two upper protrusions, two upper bevels, and two upper flanges, the shaft having a disk head, an annular groove, and a tip end, the O-ring enclosing the annular groove of the shaft, the shaft inserted through the hollow post, the spring surrounding the shaft, the spring disposed between the hollow post and the disk head of the shaft, the button device inserted in the chamber of the hollow handle, the push trigger inserted in the chamber of the hollow handle, the button device disposed between the hollow handle and the push trigger, the upper opening of the push trigger receiving the upper click block of the button device, and the upper bevels of the push trigger blocking the upper pillars of the button device.

* * * * *